US007380561B2

(12) United States Patent
Nobert et al.

(10) Patent No.: US 7,380,561 B2
(45) Date of Patent: Jun. 3, 2008

(54) PORTABLE, DISPLACEABLE ANCHOR STAND

(76) Inventors: David T. Nobert, 11 Ailsa Drive, Keswick, On. (CA) L4P 3N5; Robert Plunkett, 17 Wattie Road, Midhurst, On. (CA) L0L 1X1

( * ) Notice: Subject to any disclaimer, the term of this patent is extended or adjusted under 35 U.S.C. 154(b) by 57 days.

(21) Appl. No.: 11/488,046

(22) Filed: Jul. 18, 2006

(65) Prior Publication Data

US 2008/0017226 A1 Jan. 24, 2008

(51) Int. Cl.
*E04H 15/62* (2006.01)
*F16M 13/00* (2006.01)

(52) U.S. Cl. ..... 135/118; 248/530

(58) Field of Classification Search ..... 135/116, 135/16, 902, 118; 248/530, 545, 519; 108/165, 108/50.11, 50.12; 52/298, 165
See application file for complete search history.

(56) References Cited

U.S. PATENT DOCUMENTS 2,805,109 A * 9/1957 Kopmar ..... 108/25
3,624,732 A * 11/1971 Bowden ..... 108/50.12
4,462,197 A * 7/1984 D'Alessio et al. ..... 52/637
4,483,506 A * 11/1984 Litwiller ..... 248/545
5,065,975 A * 11/1991 Giles ..... 248/545
5,123,623 A * 6/1992 McNamara ..... 248/545
5,251,894 A * 10/1993 Boatman ..... 473/499
D364,048 S * 11/1995 Winslow, Sr. ..... D6/417
D366,372 S * 1/1996 Skarda, Jr. ..... D6/417
5,524,309 A * 6/1996 La Barbera ..... 5/658
2002/0040957 A1* 4/2002 Carter ..... 248/530
2004/0129184 A1* 7/2004 Kraker ..... 108/50.12

* cited by examiner

*Primary Examiner*—David R Dunn
*Assistant Examiner*—Kaitlin A Wilson
(74) *Attorney, Agent, or Firm*—D. W. Eggins; D. Eggins

(57) ABSTRACT

A lightweight, portable post-anchor is readily secured to the ground without the use of tools, and is readily removed for re-use elsewhere, being used with a beach-style umbrella, and/or a table. It can support citronella torches, games nets and signage. The high strength plastic anchor has integral spikes projecting downwardly, and reinforced upper and lower surfaces to provide end loading spaces, for a users foot to force the spikes into the ground. The gusset-reinforced base plate is reinforced with ribs under the loading spaces, and an upstanding gusset-reinforced tube to hold a beach umbrella and/or a table; and to serve as a lever for removing the anchor from the ground.

8 Claims, 4 Drawing Sheets

PORTABLE, DISPLACEABLE ANCHOR STAND

CROSS REFERENCE TO RELATED APPLICATIONS

Not Applicable (N/A)

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

1. The present invention provides a readily portable, light-weight ground stand, having a base portion for ready insertion into suitable terrain, with an upstanding tubular portion to carry a table and to receive the shaft of a beach umbrella or other device in inserted, supported relation therein.

2. A large number of prior support devices exist for use in providing ground-penetrating attachments. Most, if not all of these are of metal, and require the use of tools such as hammers to drive the associated spike portions into the ground. Most are intended for permanent fixtures such as fence posts, rural mailboxes, games net support posts and the like.

BRIEF SUMMARY OF THE INVENTION

The present invention provides a lightweight, portable post-anchor that is readily secured to the ground without the use of tools, and which is readily removed from its anchorage, for re-use elsewhere, or on succeeding occasions. The subject anchor may be used with a beach-style umbrella, and/or in combination with a table. It can also be used to hold citronella torches, for securing games nets; and for signage such as real-estate signs.

The subject ground anchor is of high strength plastic, having a base plate with a number of spikes in mutually spaced relation projecting downwardly from the periphery of the plate. The plate is reinforced on its upper and lower surfaces by a series of ribs and gussets, the upper series of ribs and gussets being so arranged to provide at least two loading spaces upon which a user may place their shod foot, to exert their body weight downwardly against the ground anchor, to force the spikes down into the ground. The lower surface of the base plate has ribs underlying the loading spaces, to reinforce the base plate against undue deformation under the thus applied load, with gussets reinforcing the spike portions. An upstanding, gusset-reinforced tubular portion projecting from the base plate upper surface is sized to receive the shaft of a beach umbrella in inserted relation therein. A table may also be mounted upon the anchor, with or without the umbrella.

The base plate is perforated, to allow any moisture or detritus within the tubular portion to exit downwardly into the ground. The upstanding tubular portion has stiffening gussets connecting with the base plate, to enable use of the tubular portion as a lever, in removing the ground anchor from an imbedded position, for removal and further use elsewhere.

The underlying reinforcing ribs are sufficiently deep and slender that they readily penetrate and compact the surface of the ground, and serve to stabilize the anchor with the ground.

BRIEF DESCRIPTION OF THE SEVERAL VIEWS OF THE DRAWINGS

Certain embodiments of the invention are described by way of illustration, without limitation thereto other than as set forth in the accompanying claims, reference being made to the accompanying drawings, wherein:

DETAILED DESCRIPTION OF THE INVENTION

Figure 1:
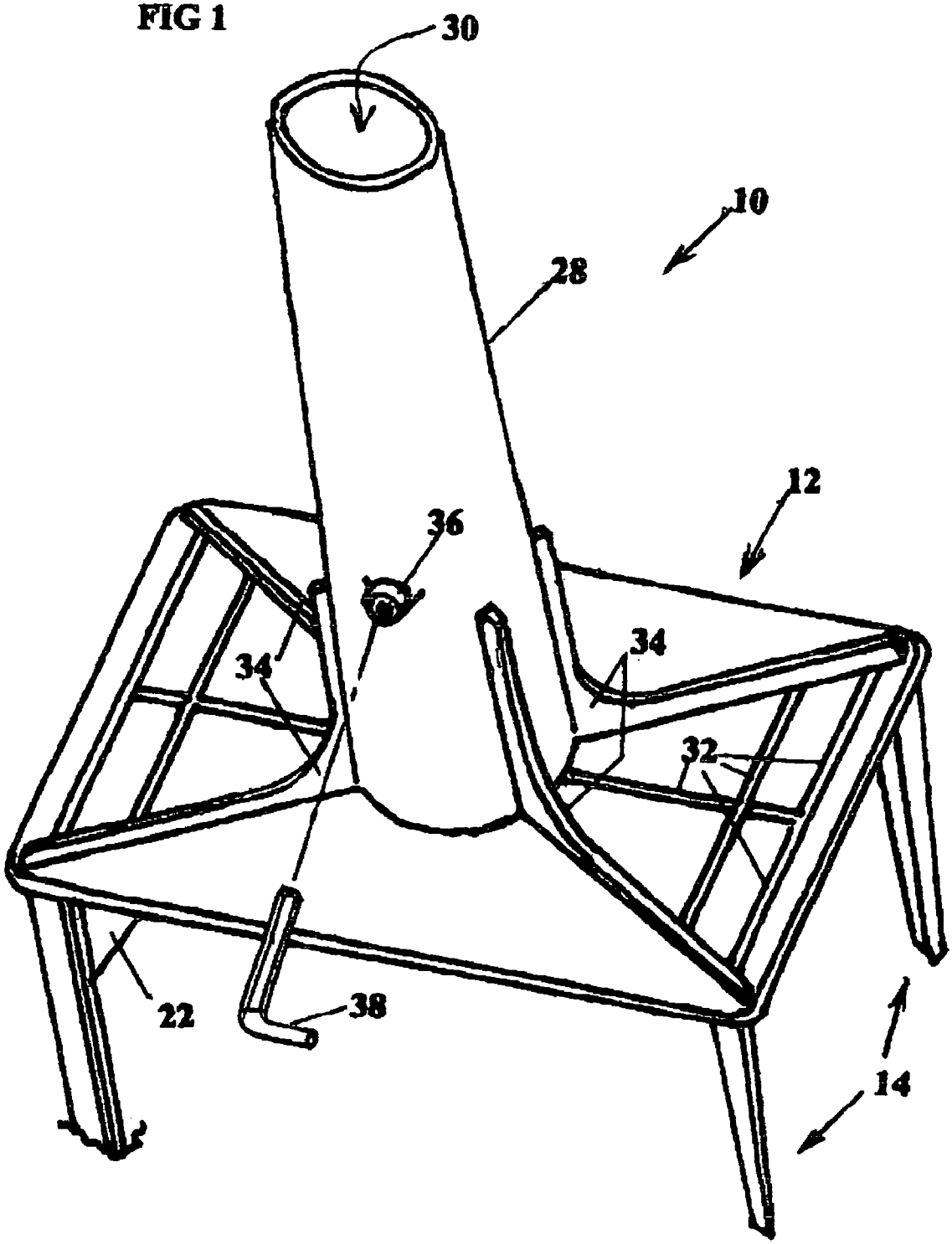
FIG. 1 is a perspective view, looking down upon the ground anchor of the present invention.
Figure 2:
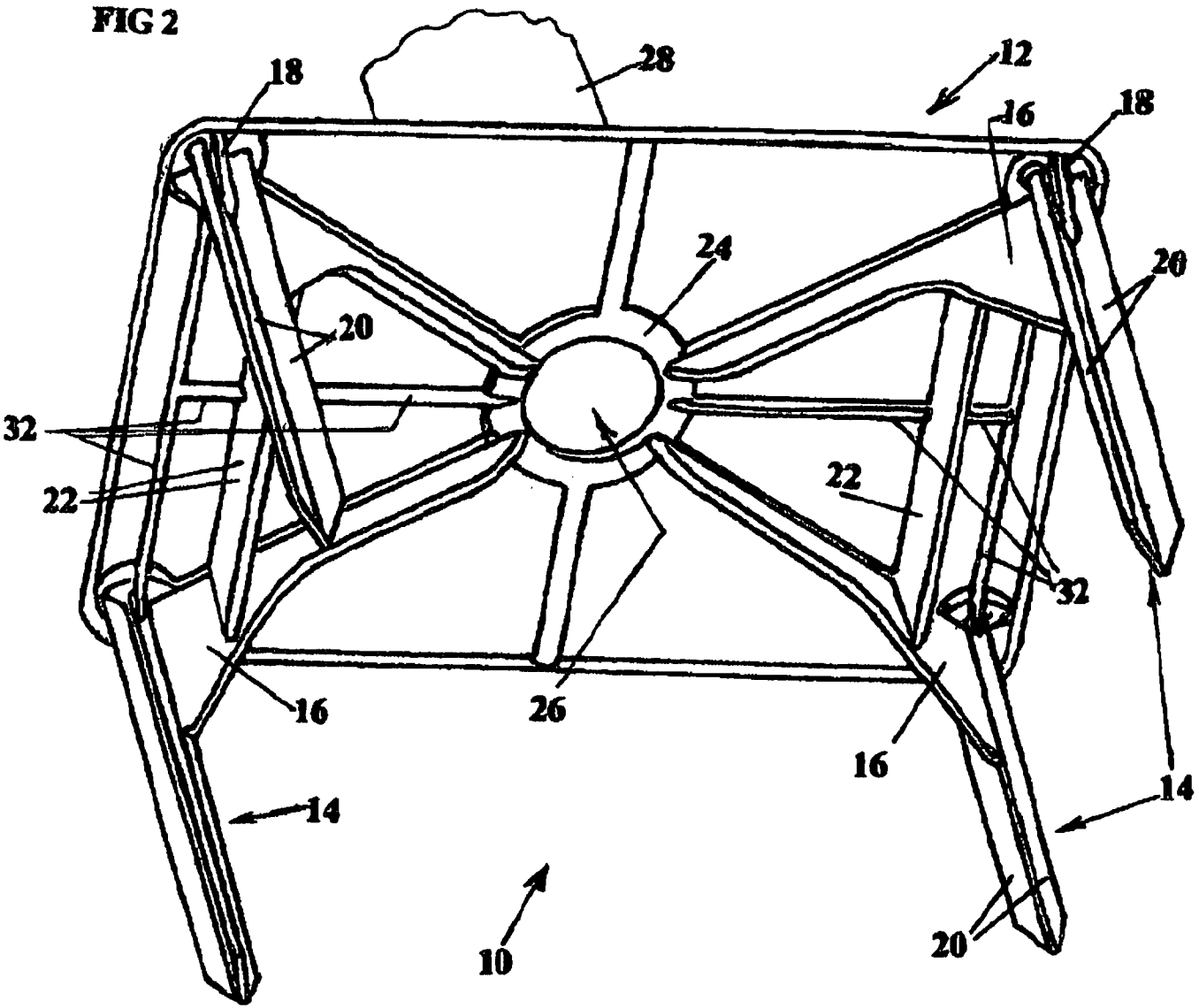
FIG. 2 is a perspective view of the ground anchor from below.

Referring to FIGS. 1 and 2, the ground anchor 10 of the present invention has a base plate portion 12 with four ribbed corner spikes 14 projecting downwardly therefrom. Each spike 14 is braced by way of a deep diagonal gusset 16 which tapers towards the centre of the base plate 12; and by a reinforcing outer gusset 18 that is located between the ribs 20 that form the spike 14.

A deep bracing rib 22 extends laterally between the pairs of gussets 16, in mutual bracing relation therewith.

A central annular reinforcement ring 24 surrounds an opening 26 that connects with the cylindrical interior 30 of the hollow post portion 28 of the anchor 10.

On the underface (FIG. 2) and the top face (FIG. 1), an assembly of reinforcing ribs 32 serve to stiffen the polycarbonate plastic structure.

The post 28, which is integrally moulded with the other portions of the base plate 10, has four diagonal gusseted stiffener ribs 34.

Figure 3:
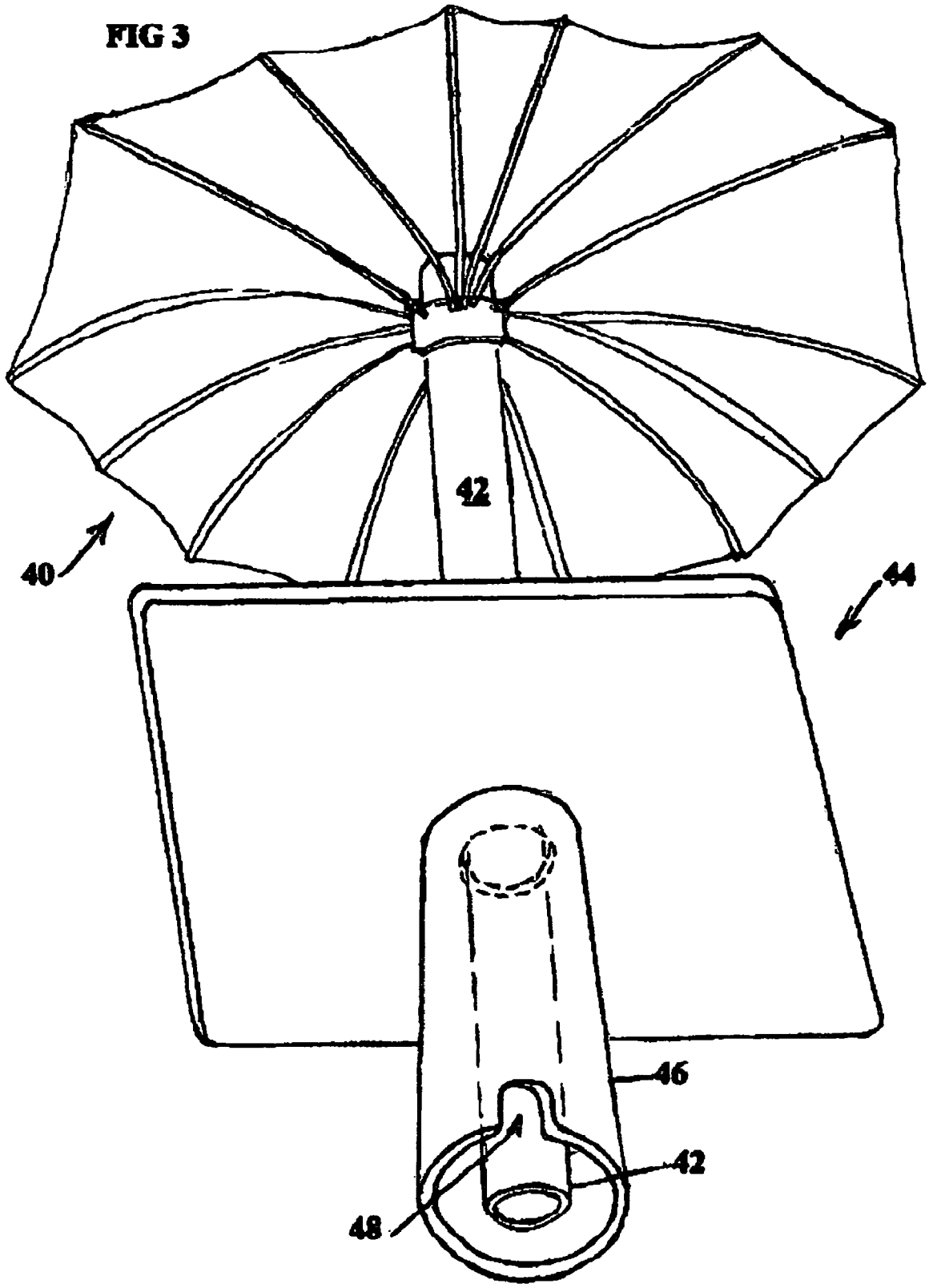
FIG. 3 is a perspective view from below of a table embodiment and an umbrella for individual or combined use with the anchor.

The post 28 has an internally threaded boss 36 for a headed locking screw 38 which releasably engages the shaft 42 of the umbrella 40 (FIG. 3)

Referring to FIG. 3, a table 44 has a tapered stand 46 which slides down over the post 28 of anchor 10. A recess 48 receives the boss 36 of post 28, to orient the table 44 with the anchor 10; the annular base of the stand 46 resting on the tops of the ribs 34 of anchor 10, to prevent jamming of the tapered table stand 46 to the outer tapered surface of the post 28. The stand 46 may be made separable from the table top, to facilitate both shipping and hand-carrying by users.

Figure 4:
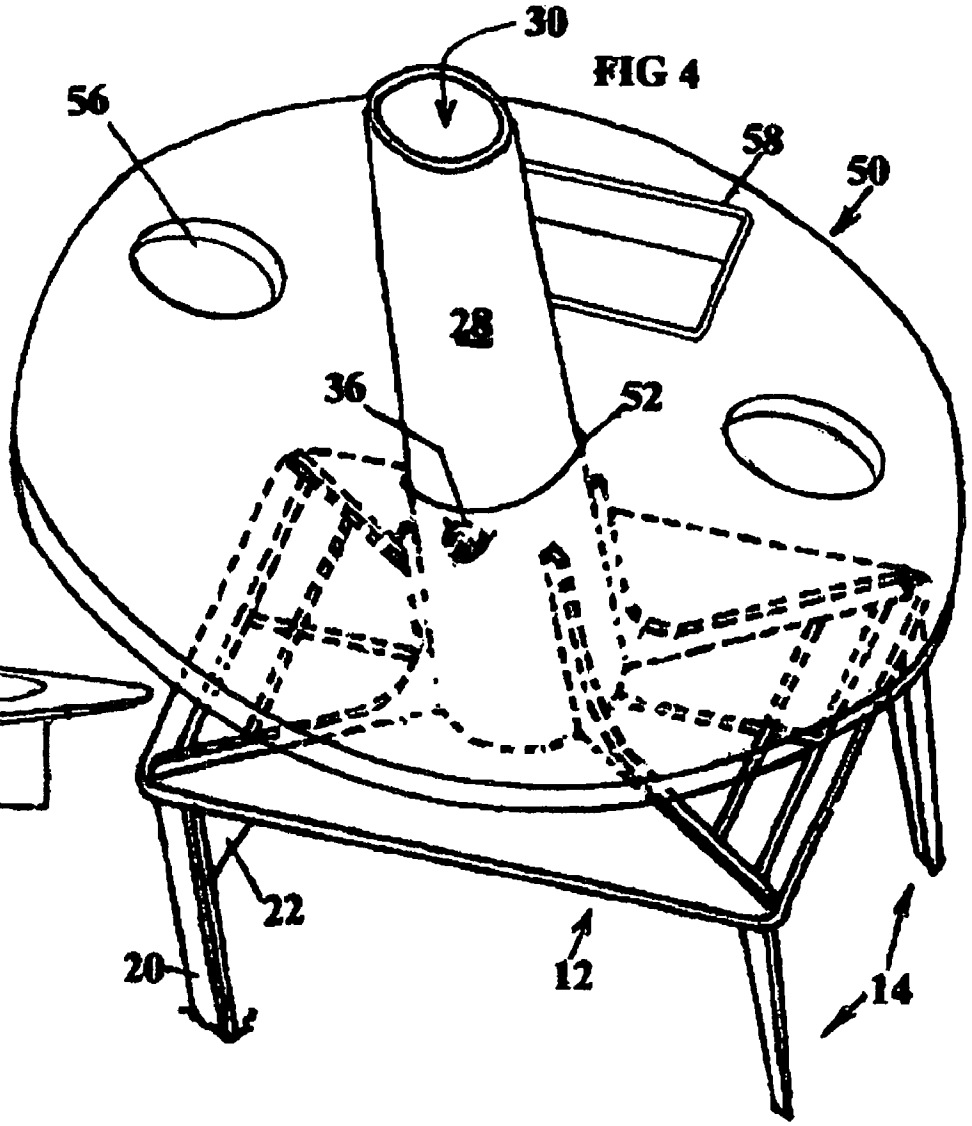
FIG. 4 is a top perspective view of a second table embodiment.
Figure 5:
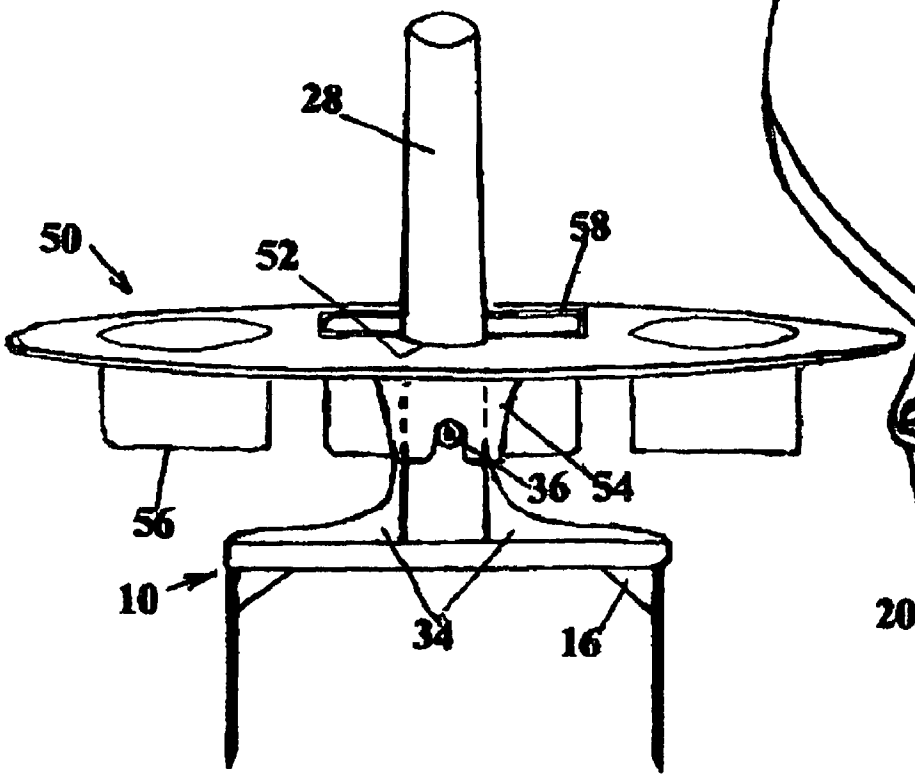
FIG. 5 is a side perspective view of the FIG. 4 embodiment

Turning to FIGS. 4 and 5, a second table embodiment 50 has an aperture 52 that fits over the post portion 28, the table 50 having a downwardly depending boss 54 that is recessed to receive the tops of the four gussets 34. The table 50 has a pair of recessed cupholders 56, and a removable accessory holder 58. The boss 54 may be removably attached to the table 50.

In use, the anchor 10 is first installed, being thrust down under foot pressure applied against the rib-reinforced end portions of base plate 12. In harder turf, such as beside a sports field, the spikes 14 will afford a good grip, without having to force the ribs 22 fully down into the turf. However, particularly in sand, the bracing ribs 22 can be forced down so as to entrap a mass of sand in stabilizing relation with the base plate 12, to stabilize it against horizontal displacement as foot pressure is applied.

It will be understood by those skilled in the art that the above disclosure is directed primarily to specific embodiments of the present invention, and that the subject invention is susceptible of reduction to practice by those skilled in the art in other embodiments that fall within the scope of the appended claims.

The inventioned claimed is:

1. A lightweight, portable ground-anchor, for securing to the ground without the use of tools, said anchor having a baseplate portion with a plurality of integral spike portions depending therefrom; first gusseted rib means securing said spike portions in braced relation with the underside of said base-plate portion; an upper surface of said base-plate portion having an upwardly extending mast portion, for supporting items selected from the group comprising table means and umbrella means; said mast portion having a conical shape to provide a thickened, stiffer base portion to resist leverage forces applied in levering said anchor from the ground; said mast means base portion having second gusseted rib means connecting to said baseplate upper surface in reinforcing relation with said mast means; said anchor upper surface having a series of shallow ribs to provide at least two loading spaces upon which a user may place their foot, to exert their body weight downwardly against the ground anchor, to force the spike portions down into the ground.

2. The ground anchor as set forth in claim 1 said first gusseted rib means being of narrow section to facilitate their entry into the ground.

3. The ground anchor as set forth in claim 1 including transversely extending rib means connecting pairs of said first gusseted rib means in bracing, ground-stabilizing relation when forced into the ground.

4. The ground anchor as set forth in claim 1, said umbrella means having a shaft for removable insertion within said mast portion.

5. The ground anchor as set forth in claim 4, said ground anchor including locking means to releasably engage said umbrella shaft when said umbrella shaft is inserted within said mast portion.

6. The ground anchor as set forth in claim 5, said locking means consisting of a locking pin extending in threaded relation through a wall portion of said mast portion.

7. The ground anchor as set forth in claim 1, said table top having a depending boss portion to receive said mast portion in entered relation therein; said table top having a recessed cup holder and a recessed accessory container.

8. A lightweight, portable ground-anchor, for securing to the ground without the use of tools, said anchor having a baseplate portion with a plurality of integral spike portions depending therefrom; first gusseted rib means securing said spike portions in braced relation with the underside of said base-plate portion; an upper surface of said base-plate portion having an upwardly extending mast portion, for supporting items selected from the group consisting of table means and umbrella means; said table means having a downwardly extending stand portion for removable mounting attachment to said mast portion in substantial enclosing relation thereover, said stand portion having orientation means to engage said mast portion in predetermined, mutually oriented relation therewith; said anchor upper surface having a series of shallow ribs to provide at least two loading spaces upon which a user may place their foot, to exert their body weight downwardly against the ground anchor, to force said integral spike portions down into the ground.

* * * * *